United States Patent [19]

Roblin

[11] 4,452,312

[45] Jun. 5, 1984

[54] MODULAR UNDERSEA OIL PRODUCTION PLANT

[75] Inventor: Jean-Paul Roblin, Nantes, France

[73] Assignee: Alteliers et Chantiers de Chantiers de Bretagne-ACB, Nantes, France

[21] Appl. No.: 351,562

[22] Filed: Feb. 23, 1982

[30] Foreign Application Priority Data

Feb. 23, 1981 [FR] France ..... 81 03506

[51] Int. Cl.[3] ..... E21B 43/013

[52] U.S. Cl. ..... 166/339; 166/340; 166/347; 405/170

[58] Field of Search ..... 166/338–347, 166/350, 351, 369, 366; 137/236 S; 405/170

[56] References Cited

U.S. PATENT DOCUMENTS

| | | | |
|---|---|---|---|
| 3,887,520 | 4/1975 | Putnam | 166/0.6 |
| 4,174,000 | 11/1979 | Milberger | 166/363 X |
| 4,214,842 | 7/1980 | Franks | 405/191 |
| 4,286,665 | 9/1981 | Walker | 166/339 |
| 4,378,848 | 4/1983 | Milberger | 166/366 X |

FOREIGN PATENT DOCUMENTS

| | | |
|---|---|---|
| 2322256 | of 0000 | France . |
| 1520758 | of 0000 | France . |
| 1595486 | of 0000 | France . |
| Ad. 95343 | of 0000 | France . |
| 2266793 | of 0000 | France . |
| 2007997 | of 0000 | France . |

*Primary Examiner*—Ernest R. Purser
*Assistant Examiner*—Michael Starinsky
*Attorney, Agent, or Firm*—Sughrue, Mion, Zinn, Macpeak and Seas

[57] ABSTRACT

A modular undersea oil production plant having at least one satellite unit whose product is conveyed by a collector pipe (10) towards a central structure (4) in which operating modules (5,6) are grouped together, said product being removed from said operating modules, wherein said satellite unit has a wellhead (1) linked by a connector (13) to the upper portion of a pipe (44) in a drill hole, an individual auxiliary module (3) which can be raised being associated with said wellhead, said module containing the control and operation components and being connected firstly to said wellhead by a first connector (23) and secondly to one end of said collector pipe (10) by a second connector (24), said wellhead (1) and said auxiliary module (3) being installed on a template (2) in two distinct cavities whose shape is complementary to that of said wellhead and of said auxiliary module which has means for disconnecting it from the collector pipe and from the wellhead and for removing it from the template (2), said disconnecting means being controllable from the surface.

4 Claims, 10 Drawing Figures

MODULAR UNDERSEA OIL PRODUCTION PLANT

The present invention relates to an undersea oil production plant.

BACKGROUND OF THE INVENTION

Undersea oil production plants comprise a number of pieces of equipment such as wellheads which are constituted by pipes equipped with master valves and by lateral valves. The wellheads are connected by connection pipes to a structure which groups together all of the wellheads and on which pipes and valves are disposed, and from which a bundle of operating pipes (riser) lead to the surface.

Installation and maintenance of this assembly require the use of divers, light submarines, etc. In deep water, such undersea operations become tricky and dangerous.

The present invention aims to group together the components which must be maintained into modular assemblies, and to enable these assemblies to be installed and raised to the surface without using divers or guide lines.

SUMMARY OF THE INVENTION

The present invention therefore provides a modular undersea oil production plant having at least one satellite unit whose product is conveyed by a collector pipe towards a central structure in which operating modules are grouped together, said product being removed from said operating modules, wherein said satellite unit has a wellhead linked by a connector to the upper portion of a pipe in a drill hole, an individual auxiliary module which can be raised being associated with said wellhead, said module containing the control and operation components and being connected firstly to said wellhead by a first connector and secondly to one end of said collector pipe by a second connector, said wellhead and said auxiliary module being installed on a template in two distinct cavities whose shape is complementary to that of said wellhead and of said auxiliary module which has means for disconnecting it from the collector pipe and from the wellhead and for removing it from the template, said disconnecting means being controllable from the surface.

According to another feature of the invention, said auxiliary module includes an operating head which can co-operate with an operating tool suspended from suspension means which include pipes necessary to operate the connectors, said suspension means transmitting the orders given at the surface.

BRIEF DESCRIPTION OF THE DRAWINGS

An embodiment of the invention is described hereinbelow with reference to the accompanying drawings in which.

MORE DETAILED DESCRIPTION

Figure 1:
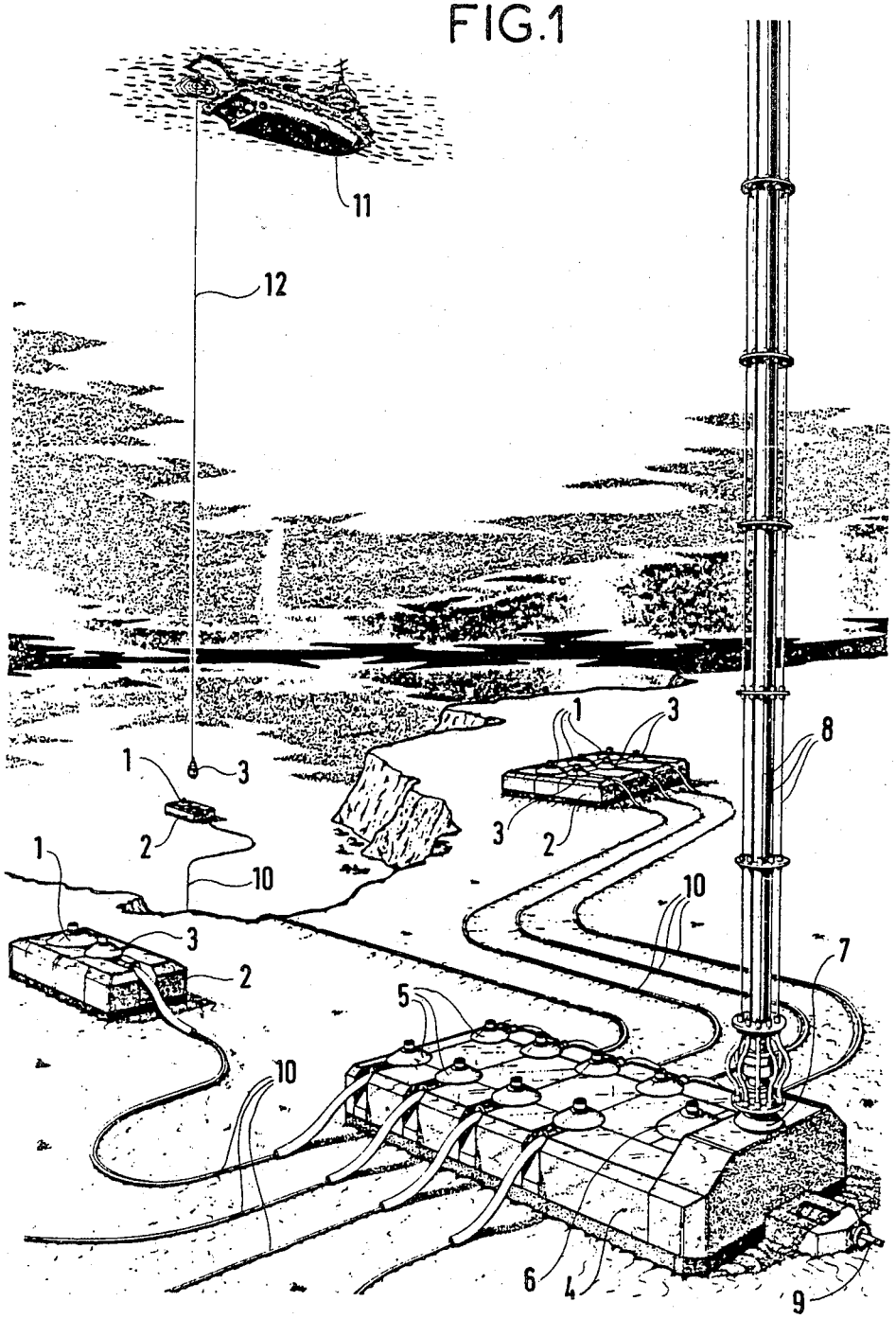
FIG. 1 is a general perspective illustration of a production plant in accordance with the invention.

FIG. 1 illustrates a plant in accordance with the present invention. The plant has a number of satellite wellheads 1 placed on templates 2. Some templates have one wellhead and others have several wellheads. Each satellite wellhead is associated with an auxiliary module 3 which has valves.

The plant further includes a structure 4 which acts as a support for a number of components. In particular, this structure is fitted with functional modules such as valve modules 5 and a selector switch module 6; it is also fitted with a base plate 7 of a bundle of operation pipes 8 which lead to the surface where an operation platform, not illustrated, processes the crude oil. The oil thus processed goes down again to the bottom via one of the pipes 8 then rises from the bottom via a pipe 9 and ends at a loading buoy on the surface. The structure 4 also has pipes (not shown in the figure) connecting the base plate 7 to the valve modules 5 and also connecting the selector switch module 6 both to the base plate 7 and to each of the valve modules 5. Such a selector switch module 6 serves to allow a tool, e.g. a pipe cleaning tool, right down into any wellhead from a length of pipe which is single at the outset. A collector pipe 10 connects each auxiliary module 3 to one of the valve modules 5. In the example illustrated in the figure, there are only satellite wells, but there could just as well be one or more wellheads on the structure 4, in which case the wellhead is directly connected to a valve module 5 and there is no need for the chain—auxiliary module 3, collector pipe 10 and valve module 5. The valve module 5 suffices on its own.

The figure shows a ship 11 lowering an auxiliary module 3 for installation on a template 2. The module 3 is suspended from a set 12 of drill pipes.

The module is equipped with cameras and possibly with an acoustic transmitter so as to locate the cavity provided in the template 2 for the module and to enable it to be guided from the surface. The module is also provided with cams which co-operate with complementary means in the cavity so as to orient properly the connectors which are to be connected to the collector pipe 10 and to the wellhead 1. These connections are made automatically in accordance with commands sent from the surface. For this purpose hydroelectric pipes are juxataposed with the set 12 of drill pipes to control jacks which allow the connections to be made.

Figure 2:
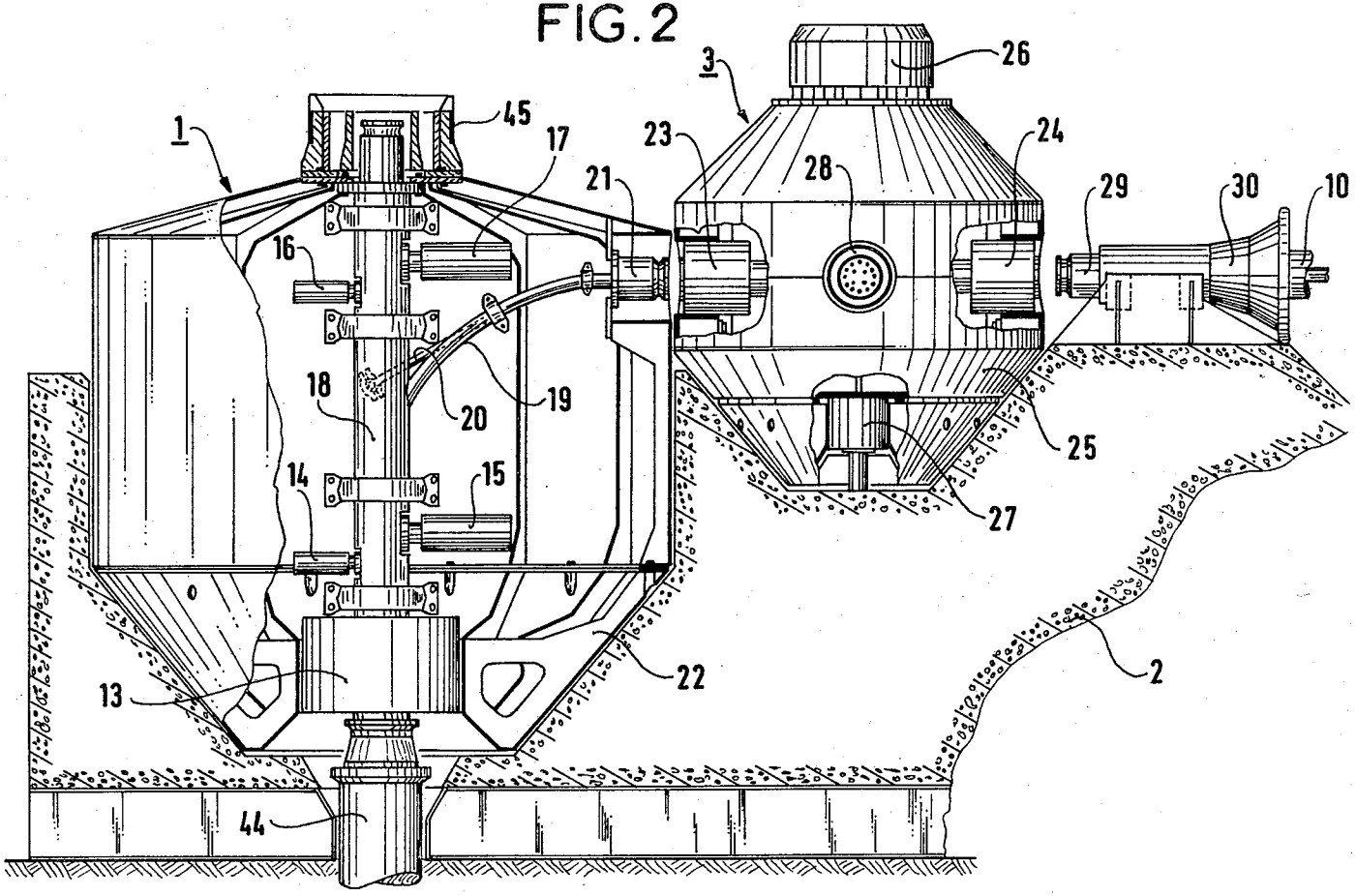
FIG. 2 is an elevational view, partially broken away which illustrates a wellhead and an auxiliary module in accordance with the invention.

FIG. 2 illustrates a wellhead 1 and an auxiliary module 3. These modules are installed on a template 2.

The wellhead mainly comprises a connector 13 to connect with the upper portion 44 of a pipe which enters the drill hole. This pipe has a central passage which is used for operational requirements, i.e. a pressurized fluid is made to flow therein if the oil discharge rate is too slow and a pressurized fluid can be sent down this passage e.g. to drive out a cleaning tool which has been inserted in the central passage.

Above the connector 13, the wellhead has a first set of valves. The figure illustrates an operating cylinder 14 for the valve which controls the annular passage and the operating cylinder for the valve which controls the central passage. A little above, there is a second set of valves which is controlled by cylinders 16 and 17 respectively. A lateral diversion pipe 18 is located between these two sets of valves. Two separate pipes 19 and 20 lead to a stationary connector 21. The central passage and the annular passage leave from the side of the diversion pipe. The above assembly thus formed is housed in a casing 22 for mechanical protection. The casing is filled with sea water at a pressure equal to that of the outside medium and additives are mixed therewith to prevent corrosion and also to prevent seaweed and other living organisms from being deposited. An operating head 45 is located at the top of the casing for use when installing. During ordinary operation, the wellhead requires no maintenance since the valves 14 and 15 are permanently open and the valves 16 and 17 are permanently closed and operation is via the lateral pipes 19 and 20. Therefore only components which are usually stationary and are hence not very vulnerable are located in the wellhead. In contrast, the operation valves and other moving components are located in the auxiliary modules 3, the valve modules 5 and the selector switch module 6 all of which can readily be raised.

All these modules are also contained in mechanical protection casings and are filled with sea water to which anti-corrosion additives are added.

FIG. 2 therefore shows an auxiliary module 3 associated with the wellhead 1. This module mainly comprises valves for the pipe 19, the pipe 20 and a valve which puts a by-pass between these two pipes. The assembly formed by this valve circuit leads to an inlet connector 23 and to an outlet connector 24.

The assembly is located in a casing 25 which includes an operating head 26 and a fixing connector 27. The casing also includes a connector 28 to remote-control the valves of the module. The supply cables for such remote control run along the collector pipe 10 and rise again to the surface via the bundle of pipes 8 or riser.

The end of the collector pipe 10 has a connector 29 which can move slightly axially in a sheath 30 connected to the template 2 to allow connection with the connector 24.

Figure 3:
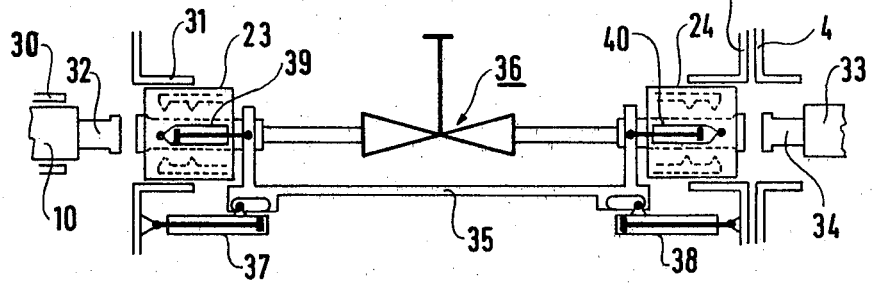
FIGS. 3 to 9 are views which, in sequence, schematically illustrate the connection kinetics of a typical module in accordance with the invention with the components which surround said module.

FIGS. 3 to 9 schematically illustrate the kinetics of connecting the connectors 23 and 24 to the connectors 21 and 29. These figures also apply to connecting the valve modules 5 (which are identical to the auxiliary modules 3) both to collector pipes 10 (whose connectors are fixed to the end unlike the connector 29 situated on the side nearest the auxiliary module) and to the pipes connected to the structure 4, which pipes lead both to the selector switch module 6 and to the base plate 7. These pipes, not shown, each have a connector such as 24 and are also free to move axially like the connector 29. FIG. 3 schematically illustrates at 31 the casing 25 of an auxiliary module 3 or of a valve module 5.

In the present case, the module in question is a valve module 5 since it is placed between one end of a collector pipe 10 with its connector 32 installed permanently in its sheath 30 and one end of a pipe 33 connected to the structure 4. As stated hereinabove, these ends each have an axially movable connector 34 e.g. by means of a loop formed at the end of the pipe.

In this figure, the stationary connector 32 on the end of the collector pipe 10 therefore corresponds to the stationary connector 21 in the case of connection of an auxiliary module 3 to a wellhead 1 (FIG. 2) and the moving connector 34 corresponds to the moving connector 29 on the other end of the collector pipe 10.

The set of components of the module is assembled on a cradle 35 which moves relative to the casing 31. The set of valves is schematically illustrated at 36. The figure illustrates again the inlet connector 23 and the outlet connector 24 as in the case of an auxiliary module. Jacks 37 and 38 move the cradle and the connectors are also axially movable relative to the cradle by means of jacks 39 and 40.

At the outset, before connection, all the jacks are in the retracted position and the cradle 35 is in the middle position as illustrated in FIG. 3.

Figure 4:
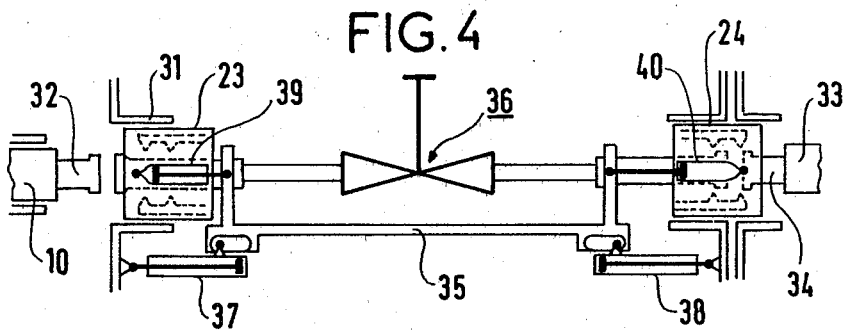

In FIG. 4, the connector 24 is moved in translation towards the right to meet the moving connector 34 due to extension of a jack 40.

Figure 5:
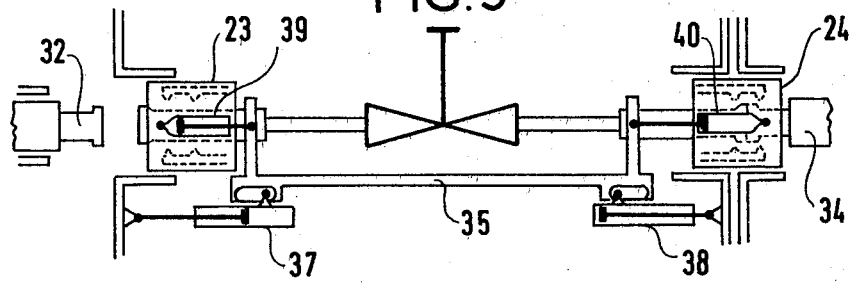

In FIG. 5, the cradle 35 is moved in translation to the right due to extension of a jack 37. The two connectors 24 and 34 are in contact with each other.

Figure 6:
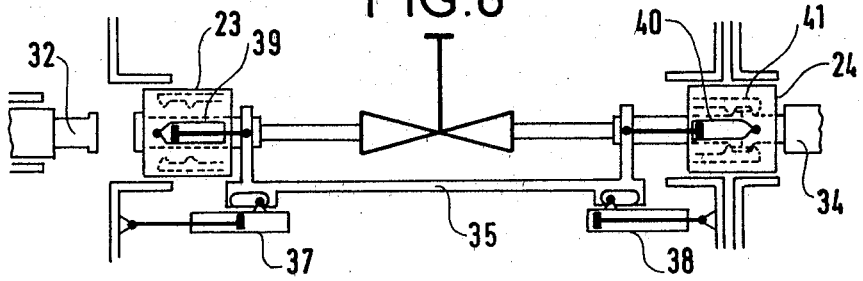

In FIG. 6, latches 41 are locked. Connection is ended on the side nearest the structure 4.

Figure 7:
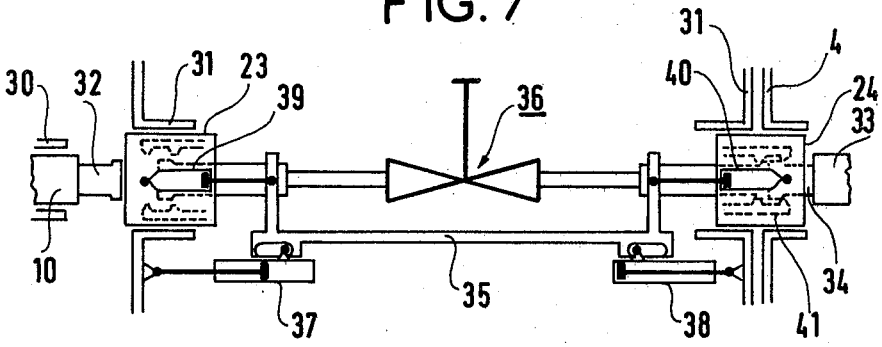

In FIG. 7, the connector 23 is moved in translation to the left to meet the stationary connector of the end of the connection pipe 10 due to extension of a jack 39.

Figure 8:
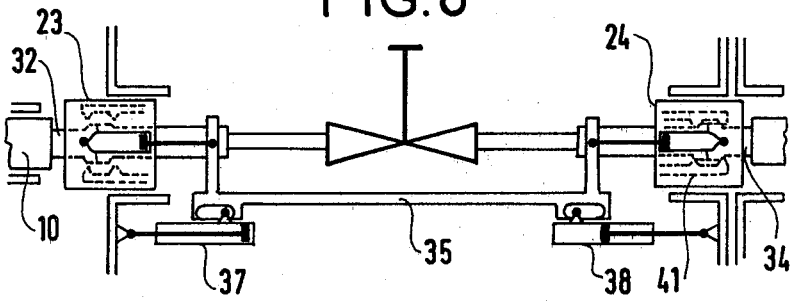

In FIG. 8, the cradle is moved in translation to the left due to extension of a jack 38 while a jack 39 retracts freely. The connectors 32 and 23 are in contact with each other. During the movement of the cradle to the left, the moving connector 34 is also driven in this movement.

Figure 9:
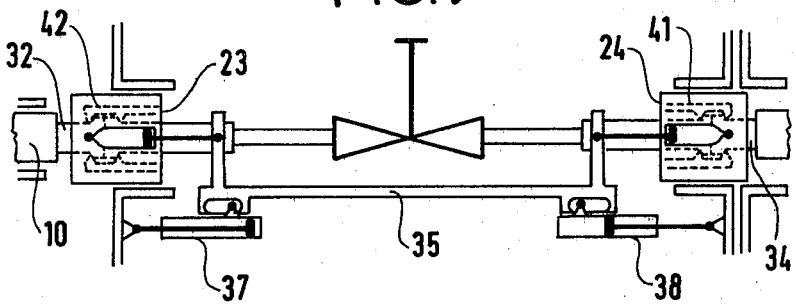

In FIG. 9, latches 42 are locked. Connection is completed.

When the module is to be raised to the surface for maintenance, the process is reversed. The connection operations described hereinabove are controlled from the surface and commands are transmitted by remote-control cables running along the set of drill pipes and used for lowering and raising the operating modules. The connections for fixing the wellheads 1 by means of the connectors 13 or by means of the connectors 27 of the auxiliary modules 3 or of the operating modules of the structure 4 are also controlled from the surface and the commands which control them are transmitted by these same cables.

Figure 10:
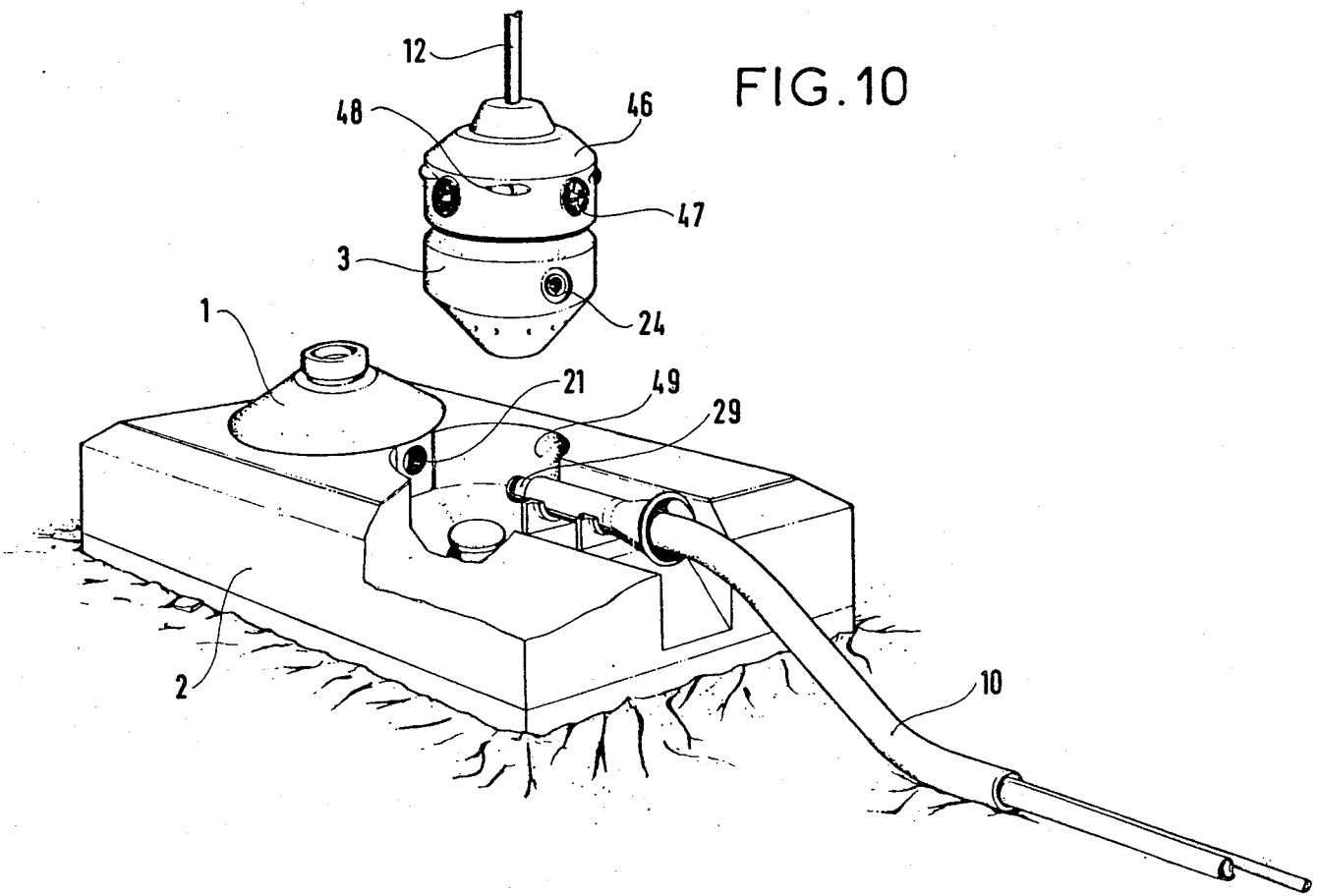
FIG. 10 is a perspective view which illustrates on a larger scale a detail of FIG. 1.

FIG. 10 illustrates an auxiliary module 3 being lowered to be placed on the template 2. The process is identical for a valve module 5 or a selector switch module 6.

An operating tool 46 is connected to the auxiliary module 3 by its operating head 26 (FIG. 2) and the assembly thus formed is lowered by means of a carrier cable 12 or else by a set of drill pipes with an umbilical drive unit joined thereto for remote control of the jacks and of the tool operating components.

The operating tool 46 has horizontal propulsion means 47 and orientation nozzles which co-operate with optical or acoustic means to guide and orientate the module. Once the module is placed in its cavity 49 and the connections are made with the connectors 21 and 29, the operating tool is raised.

I claim:

1. A modular undersea oil production plant having at least one satellite unit and a central structure, a collector pipe conveying satellite products towards said central structure, said central structure having operating modules grouped together, means for removing said product from said operating modules within said central structure, the improvement wherein said satellite unit has a wellhead linked by a connector to the upper portion of a pipe in a drill hole, a raisable individual auxiliary module, said auxiliary module containing control and operation components, said satellite unit comprising a template bearing two distinct cavities whose shape is complementary to that of said wellhead and said auxiliary module, said cavities receiving said wellhead and said auxiliary module with their sidewalls in juxtaposition and facing each other, and wherein the sidewall of said auxiliary module is in juxtaposition and faces the end of said collector pipe, said wellhead being linked by a connector internally thereof to an upper portion of a pipe in a drill hole beneath said template, and said auxiliary module containing control and operation components and being connected firstly to said wellhead by a first connector through said juxtaposed sidewall of said wellhead and said auxiliary module and secondly directly to said one end of said collector pipe by a second connector through said auxiliary module sidewall, and means carried by said auxiliary module controllable from the surface for controlling solely at said auxiliary module, the disconnection of said auxiliary module from the collector pipe and from the wellhead and for removing it from the template.

2. A production plant according to claim 1, wherein said auxiliary module includes an operating head, and said plant further comprises an operating tool suspended from suspension means for operatively engaging said operating head, said operating tool including means necessary to operate the connectors of said auxiliary module, and wherein said suspension means further includes means for transmitting orders given at the surface to said control and operation components of said auxiliary module via said operating tool.

3. The production plant according to claim 1, wherein said auxiliary module comprises a casing borne by said template cavity, said casing bearing diametrically opposed openings aligned respectively with a connector borne by the end of said collector pipe and by another connector, said connectors being in juxtaposition to said opening, a carriage within said casing, spanning the interior of said casing and in alignment with said openings, means for mounting said carriage for movement laterally towards and away from said casing openings, a tubular module connector pipe mounted on said carriage, spanning across the interior of said casing and having ends in alignment with said openings and with said collector pipe connector and said other connector, inlet and outlet connectors concentrically surrounding the ends of said module connector pipe and movable axially of said module connector pipe for projection through said casing openings and retraction therein, said inlet and outlet connectors including latches for locking abutting ends of said module connector pipe and said collector pipe and said other connector together, and means for selectively and independently moving said cradle relative to said casing bidirectionally and said inlet and outlet connectors relative to said module connector pipe and for unlocking and locking said latches to effect hydraulic connection and disconnection of the ends of said module connector pipe via said inlet and outlet connectors to the end of said collector pipe and said other connector to allow fluid flow from said collector pipe via the inlet connection and through said modular connector pipe and said outlet connection to said other connector.

4. The production plant according to claim 3, wherein said means for selectively moving said inlet and outlet connectors relative to said module connector pipe and said cradle relative to said casing comprises two sets of jacks mounted between said cradle and said casing and between said cradle and said inlet and outlet connectors such that connection is achieved in sequence with said inlet and outlet connectors fully retracted and said cradle located centrally of the module casing by operating the jacks of said second set connecting the outlet connector to the cradle to shift the outlet connector to a position such that partially surrounds the end of said other connector, one of said jacks of said set connecting the cradle to said module casing is actuated to further shift the outlet connector relative to the other connector to achieve abutting contact between those two connectors and to permit latches to lock these two connectors together, the inlet connector may then be projected through the other opening of the module casing so as to partially receive the connector at the end of the collector pipe, by the other jack of said second set, and finally by operation of the other jack of said first set, said cradle may be moved relative to said casing to fully project said inlet connector into contact with the connector borne by the end of the connector pipe, thereby permitting the latching of said inlet connector to latch said inlet connector to the connector by the end of the collector pipe.

* * * * *